US010953272B2

(12) United States Patent
Pelosi

(10) Patent No.: US 10,953,272 B2
(45) Date of Patent: Mar. 23, 2021

(54) DEVICE FOR USE WITH YOGA MAT

(71) Applicant: Rose Pelosi, Venice, CA (US)

(72) Inventor: Rose Pelosi, Venice, CA (US)

( * ) Notice: Subject to any disclaimer, the term of this patent is extended or adjusted under 35 U.S.C. 154(b) by 147 days.

(21) Appl. No.: 15/484,098

(22) Filed: Apr. 10, 2017

(65) Prior Publication Data

US 2017/0296863 A1 Oct. 19, 2017

Related U.S. Application Data

(60) Provisional application No. 62/322,061, filed on Apr. 13, 2016.

(51) Int. Cl.
*A63B 21/00* (2006.01)
*A63B 71/06* (2006.01)
*A63B 69/00* (2006.01)

(52) U.S. Cl.
CPC ..... *A63B 21/4039* (2015.10); *A63B 21/4035* (2015.10); *A63B 21/4037* (2015.10); *A63B 69/0057* (2013.01); *A63B 2071/0694* (2013.01)

(58) Field of Classification Search
CPC ..... A63B 21/4039; A63B 21/4035; A63B 21/4037; A63B 2071/0694; A63B 69/0057
See application file for complete search history.

(56) References Cited

U.S. PATENT DOCUMENTS 1,981,379 A * 11/1934 Thomson ..... A63B 23/10 606/237
2,465,725 A * 3/1949 Herzmark ..... A61H 7/00 601/28
2,820,454 A * 1/1958 Wright ..... A61H 7/001 601/28
3,744,483 A * 7/1973 Picolin ..... A61H 7/001 601/28
4,210,134 A * 7/1980 Okazaki ..... A61H 39/04 5/421
4,329,981 A * 5/1982 Dungl ..... A61H 7/001 601/28
4,350,152 A * 9/1982 Strakowski ..... A61H 1/008 5/630
5,096,188 A * 3/1992 Shen ..... A61H 7/001 482/51
D409,753 S * 5/1999 Affholter ..... D24/188
6,491,196 B1 * 12/2002 Coler ..... A45F 3/14 224/250
D471,636 S * 3/2003 Yu ..... D24/212
6,579,250 B2 * 6/2003 Robbins, III ..... A47G 27/0206 428/120
6,640,359 B1 * 11/2003 Alane ..... A47G 27/0237 5/417
D490,530 S * 5/2004 Chen ..... D24/211
6,742,289 B2 * 6/2004 Celmo ..... A43B 7/1465 36/141
D496,110 S * 9/2004 Kim ..... D24/211
6,821,260 B2 * 11/2004 Fors ..... A61H 7/00 601/115
7,107,626 B1 * 9/2006 Andrews ..... A41B 11/004 2/239
7,485,102 B2 * 2/2009 Zake ..... A61H 15/00 601/134

(Continued)

*Primary Examiner* — Garrett K Atkinson

(57) ABSTRACT

A device adapted to adhere to a yoga mat comprises a body comprising a convex portion and a planar portion, and an adhesive element on the planar portion for adhering the body to the yoga mat.

14 Claims, 4 Drawing Sheets

(56) References Cited

U.S. PATENT DOCUMENTS 7,819,777 B1 * 10/2010 Service ..... A63B 21/4037 482/23
8,025,606 B2 * 9/2011 Hamilton ..... A63B 71/0622 482/4
D649,653 S * 11/2011 Halvorsen ..... D24/215
8,801,530 B2 * 8/2014 Beck ..... A63B 60/10 473/201
9,295,872 B2 * 3/2016 Martens ..... A63B 21/4029
9,950,208 B2 * 4/2018 Willis ..... A63B 21/4037
D819,824 S * 6/2018 Moehlenbrock ..... D24/211
D822,221 S * 7/2018 Huth ..... D24/211
10,493,350 B2 * 12/2019 DeMarch ..... G09B 19/003
10,646,762 B2 * 5/2020 Bowers ..... A63B 63/00
2004/0088788 A1 * 5/2004 Alane ..... A47G 27/0237 5/420
2004/0250346 A1 * 12/2004 Vasishth ..... A47G 27/0237 5/417
2004/0261289 A1 * 12/2004 Lindsay ..... A43B 7/142 36/7.5
2005/0239604 A1 * 10/2005 Denham ..... A63B 21/4037 482/23
2006/0035774 A1 * 2/2006 Marks ..... A63B 71/0686 482/148
2007/0020449 A1 * 1/2007 Hing ..... A63B 21/4037 428/318.4
2007/0057460 A1 * 3/2007 Swaab ..... A63F 3/04 273/259
2007/0233506 A1 * 10/2007 Moore ..... G06Q 50/00 705/500
2008/0005947 A1 * 1/2008 Barna ..... G09F 19/22 40/629
2010/0048356 A1 * 2/2010 Hamilton ..... A63B 71/0622 482/4
2011/0070569 A1 * 3/2011 Martens ..... A63B 21/154 434/247
2012/0015334 A1 * 1/2012 Hamilton ..... A63B 71/0622 434/247
2012/0295723 A1 * 11/2012 Beck ..... A63B 71/141 473/201
2012/0304382 A1 * 12/2012 Sole ..... A47G 27/0206 5/487
2013/0190151 A1 * 7/2013 Scholder ..... A63B 21/4039 482/142
2014/0329044 A1 * 11/2014 Fantin ..... B32B 3/18 428/71
2015/0101123 A1 * 4/2015 Robo ..... A63B 21/4037 5/417
2015/0126340 A1 * 5/2015 White ..... A63B 23/1236 482/93
2016/0030800 A1 * 2/2016 McClure ..... A63B 22/16 482/146
2017/0100652 A1 * 4/2017 Bowers ..... A63B 63/00
2019/0233992 A1 * 8/2019 Ziadeh ..... A63B 60/18

* cited by examiner

DEVICE FOR USE WITH YOGA MAT

CROSS-REFERENCE TO RELATED APPLICATION

The present application claims the benefit of priority to U.S. Provisional Patent Application No. 62/322,061, filed Apr. 13, 2016, titled "DEVICE FOR USE WITH YOGA MAT", which is hereby incorporated by reference in its entirety.

FIELD

The present invention relates generally to yoga and more particularly, to devices for use with yoga mats.

BACKGROUND

Yoga is a physical, mental, and spiritual discipline with roots in India. Because of its many benefits, yoga has grown in popularity and is now practiced worldwide. The practice of yoga involves the flow and transition of many interconnected movements, many of which involve a person's hands acting as support on the ground. Due to the physical intensity of some movements, a person's hands may become sweaty and lose traction with the ground during a yoga session, leading to hand slippage that reduces effectiveness and enjoyment of the yoga session.

An additional concern regards the hand muscles themselves, which need to be trained by proper hand placement on the ground such that the person's weight is supported by the balls of the hand, as opposed to the heels of the hand.

Accordingly, there is a need for a device that overcomes the shortcomings stated above.

SUMMARY

The present invention aims to address the above by providing a device designed to prevent hand slippage while simultaneously training hand muscles for yoga movements, and methods thereto.

An exemplary embodiment of a device adapted to adhere to a yoga mat comprises a body comprising a convex portion and a planar portion, and an adhesive element on the planar portion for adhering the body to the yoga mat.

In related versions, the adhesive element comprises a first adhesive layer and a second adhesive layer.

In related versions, the second adhesive layer is adjacent to the planar portion of the body.

In related versions, the first adhesive layer and the second adhesive layer are separated by a partition.

In related versions, the first adhesive layer is adapted to create a temporary bond between the body and the yoga mat.

In related versions, the second adhesive layer is adapted to create a permanent bond between the body and the yoga mat.

In related versions, the convex portion comprises a hemisphere.

A device adapted to adhere to a yoga mat comprises a rubberized body comprising a convex portion and a planar portion, and an adhesive element on the planar portion for adhering the body to the yoga mat, the adhesive element comprising a first adhesive layer and a second adhesive layer.

In related versions, the first adhesive layer is less sticky than the second adhesive layer.

In related versions, the convex portion comprises a hemisphere.

In related versions, the convex portion comprises a cube.

In related versions, the convex portion comprises a triangular prism.

In related versions, the rubberized body is sized to fit at least one metacarpophalangeal knuckle of a user.

In related versions, the rubberized body prevents a user's hand from slipping on the yoga mat.

A method of training and preventing a user's hand from slipping on a yoga mat comprises locating a portion of the yoga mat corresponding to where the user's hand is placed, and adhering at least one rubberized device to the portion of the yoga mat.

In related versions, the portion of the yoga mat corresponds to where the user's hand is placed in a specific yoga position.

In related versions, the specific yoga position is downward dog.

In related versions, the method further comprises temporarily adhering the at least one rubberized device to the portion of the yoga mat to verify that it is an acceptable location.

In related versions, at least four rubberized devices are adhered to the portion of the yoga mat, each of the at least four rubberized devices corresponding to at least one metacarpophalangeal knuckle of the user's hand.

In related versions, the at least one rubberized device comprises a visual element.

The contents of this summary section are provided only as a simplified introduction to the invention, and are not intended to be used to limit the scope of the appended claims. The present disclosure has been described above in terms of presently preferred embodiments so that an understanding of the present disclosure can be conveyed. However, there are other embodiments not specifically described herein for which the present disclosure is applicable. Therefore, the present disclosure should not be seen as limited to the forms shown, which should be considered illustrative rather than restrictive.

DRAWINGS

Other systems, methods, features and advantages of the present invention will be or will become apparent to one of ordinary skill in the art upon examination of the following figures and detailed descriptions. It is intended that all such additional apparatuses, systems, methods, features and advantages be included within this description, be within the scope of the present invention, and be protected by the appended claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Various aspects are now described with reference to the drawings. In the following description, for purposes of explanation, numerous specific details are set forth in order to provide a thorough understanding of one or more aspects. It may be evident, however, that the various aspects may be practiced without these specific details. In other instances, well-known structures and devices are shown in block diagram form in order to facilitate describing these aspects.

Figure 1:
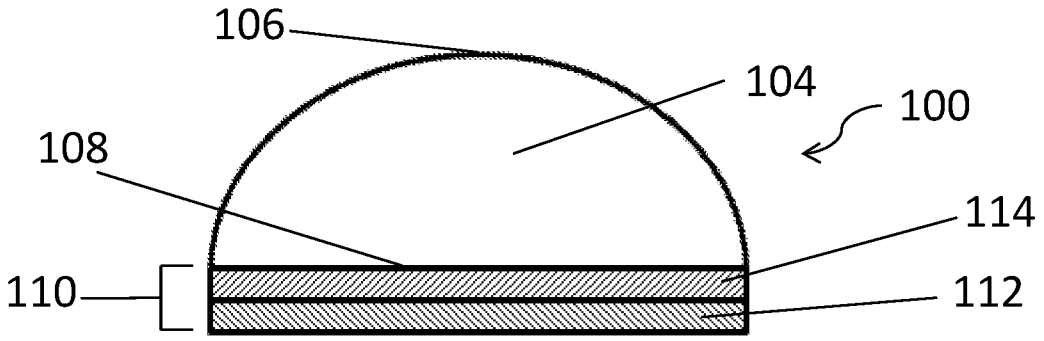
FIG. 1 is a close-up side view of a device for use with yoga mats, in accordance with aspects of the present disclosure.
Figure 2:
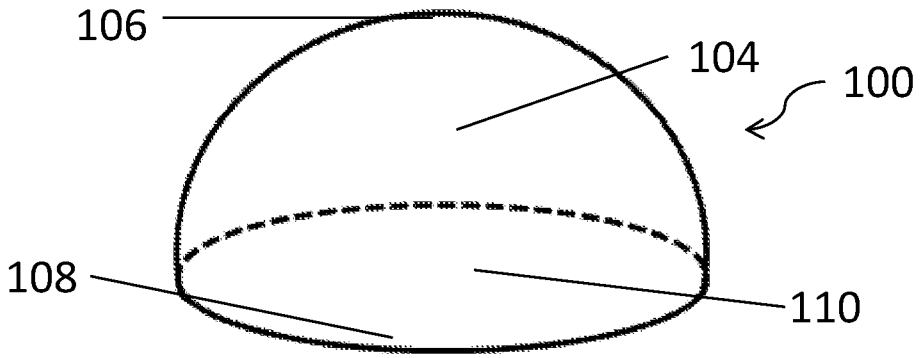
FIG. 2 is a close-up perspective view of the device of FIG. 1, in accordance with aspects of the present disclosure.
Figure 3:
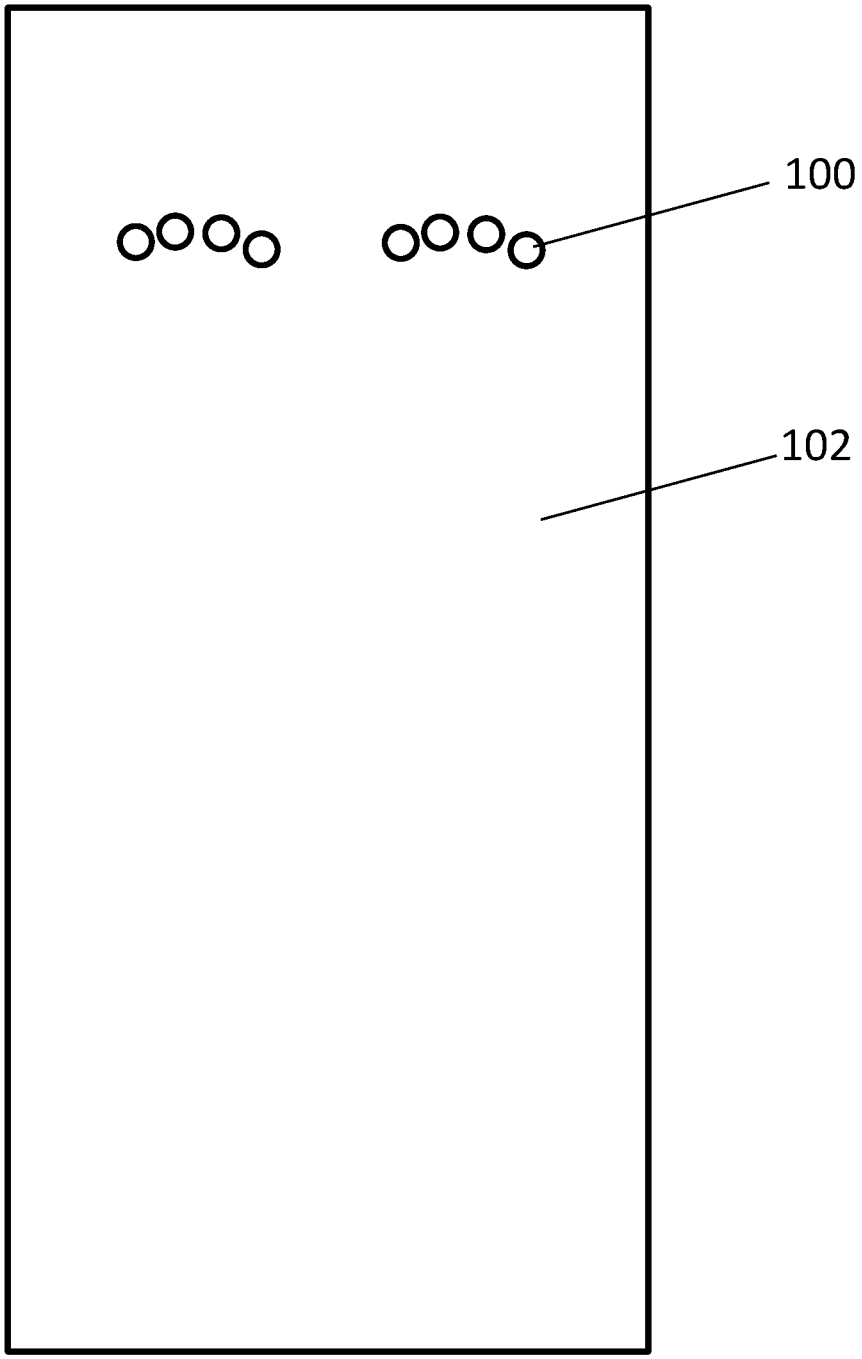
FIG. 3 is a top view of the device of FIG. 1 in use with a yoga mat, in accordance with aspects of the present disclosure.

Referring to FIGS. 1-3, an exemplary embodiment of a device 100 adapted to adhere to a yoga mat 102 comprises a body 104 comprising a convex portion 106 and a planar portion 108, and an adhesive element 110 on the planar portion for adhering the body 104 to the yoga mat 102.

The device 100 can comprise a rubberized body 104, as known in the art to prevent hand slippage. The body 104 can further comprise any other hard or soft plastics as known in the art. The plastics can be sticky, smooth, rough, or otherwise textured as known in the art to increase hand slippage prevention.

The convex portion 106 can be shaped as a hemisphere, a rectangular prism, a cube, a triangular prism, a pyramid, a star shape, or any other three dimensional shape as known in the art. The convex portion 106 can have sharp or rounded edges. The convex portion 106 can protrude upward at various heights from the planar portion 108, from anywhere between 0.1 mm to 0.5 mm. The body 104 can have a diameter or length of anywhere from 0.25 mm to 2 mm. The size and shape of the device 100 can vary depending on the size of each user's hand.

In related versions, the body 104 can be sized to fit at least one metacarpophalangeal knuckle of a user. For example, the device 100 can comprise a plurality of bodies, each body 104 having a different size and shape, individually adapted to fit to each of the metacarpophalangeal knuckles of a user. Alternatively, the plurality of bodies can all be the same shape and size, or any combination of similar and/or different according to the needs of each user.

The adhesive element 110 can comprise a first adhesive layer 112 and a second adhesive layer 114. The second adhesive layer 114 can be adjacent to the planar portion 108 of the body. In related versions, the first adhesive layer 112 and the second adhesive layer 114 are separated by a partition. For example, the partition can be a thin plastic sheet as known in the art for creating a separation between the first adhesive layer 112 and the second adhesive layer 114, such that they do not stick to each other. In certain versions, the partition is attached to the first adhesive layer 112 such that peeling off the first adhesive layer 112 also peels off the partition. Furthermore, the first adhesive layer 112 can comprise a cover as known in the art to prevent exposure of the first adhesive layer 112 to prevent drying and retain stickiness of the first adhesive layer 112.

The first adhesive layer 112 can comprise a temporary bonding substance to create a temporary bond between the body 104 and the yoga mat 102 (e.g., removably attached to the yoga mat). For example, the temporary bonding substance can be a removable sticky substance as known in the art, such as re-adherable glue. This way, a user can test out different locations on the yoga mat 102 to place the device 100 to find an ideal location for placement.

The second adhesive layer 114 can be stickier than the first adhesive layer 112 and can be adapted to create a permanent bond between the body 104 and the yoga mat 102. For example, the second adhesive layer 114 can comprise a permanent glue as known in the art. The permanent glue can create a secure permanent bond, but can be removable without leaving a mark on the yoga mat 102, as known in the art. Once the user finds the ideal location for placement, the second adhesive layer 114 is exposed by peeling off the first adhesive layer 112 and the partition, and the device 100 can be permanently bonded to the yoga mat 102 at the ideal location.

In use, the device 100 can prevent hand slippage on the yoga mat 102, and can also train the user's hand muscles for proper yoga form for various yoga positions. For example, a downward dog position requires the user to place both their hands and feet on the yoga mat 102. Instead of putting all of their weight into the heel of their hands, the device 100 can train the user to put their weight onto the balls (i.e., the location on a user's palm where the metacarpophalangeal knuckle is located, where the metacarpal bone meets the phalange bone) of their hands, thus encouraging proper yoga form. Additionally, by shifting their weight to the balls of their hands, less strain and excessive pressure is placed on the wrist joint, thus preventing injury to the wrist as well.

Figure 4:
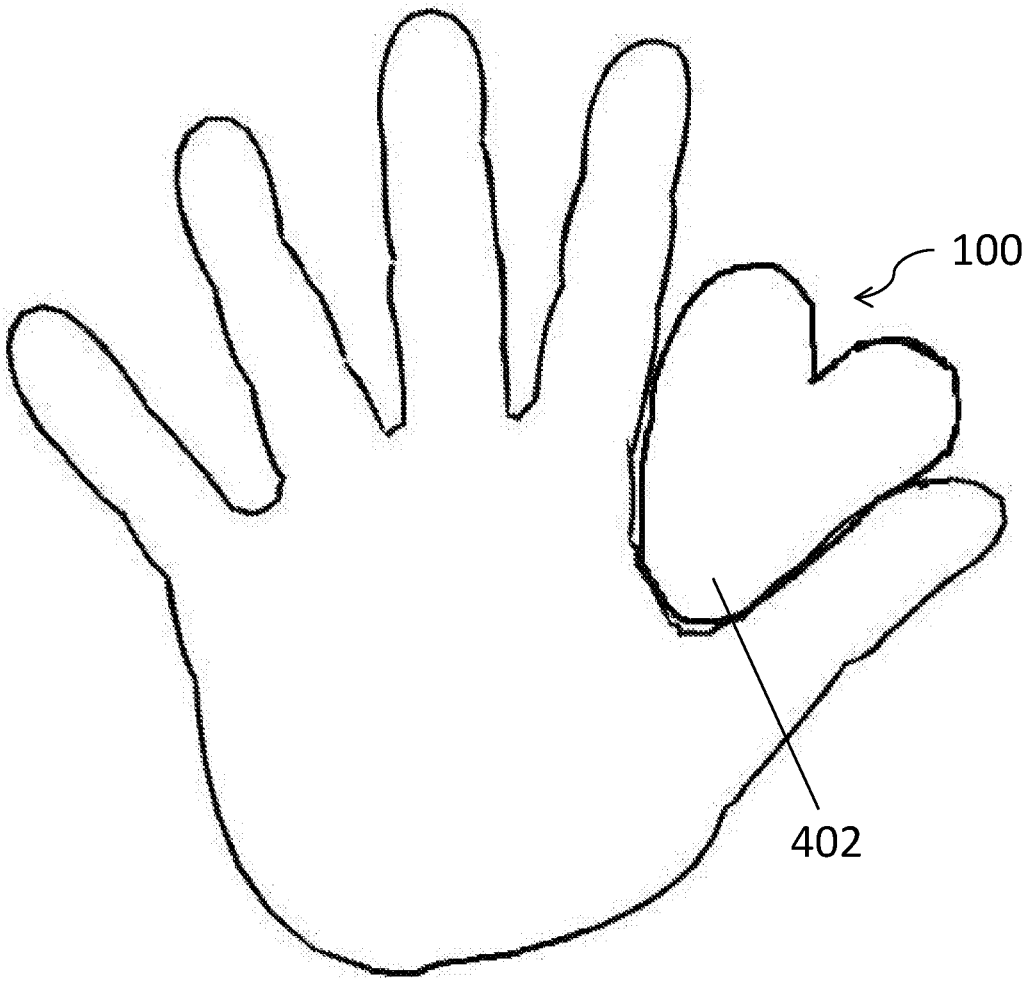
FIG. 4 is a top view of an exemplary configuration of the device, in accordance with aspects of the present disclosure.

In related versions the device 100 may be adapted to be used between each finger of a user's hands to prevent hand slippage and ensure proper form, according to the description herein. For example, the device may be shaped to fit between the thumb and forefinger of a user's hands (e.g., at the purlicue). As shown in FIG. 4, an exemplary configuration of the device 100 may be a heart shape. The bottom 402 of the heart shape may be configured to fit between the user's thumb and index finger. Of course, other configurations are possible, such as other shapes (e.g., circular, rectangular, triangular, rounded edges, sharp edges, amorphous, etc.) that include portions which fit between a user's fingers. Additionally, the device 100 may be sized and shaped for use between any two or more of the user's fingers. For example, between the thumb and index fingers, between the index and middle fingers, between the middle and ring fingers, between the ring and pinky fingers, between the thumb, index, and middle fingers, etc. Similar to the above, the device 100 may include an adhesive, and may be removably secured to any location on a yoga mat comfortable for the user (e.g., meticulous placement).

Advantages include emphasizing pressure throughout the fingers, which engages the user's bicep muscles as well as the user's other muscles (e.g., as described above and herein with regards to various yoga positions, such as downward dog). This leads to better form and acceleration of the user's yoga ability. The shape has decorative value as well, in addition to being useful for preventing hand slippage and assisting in hand placement.

Figure 5:
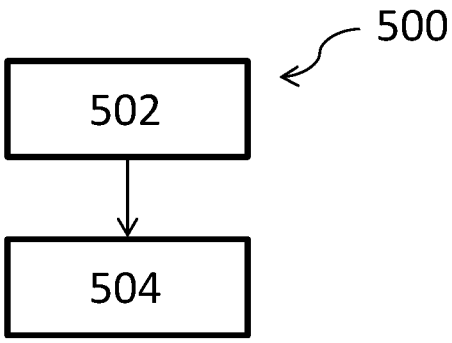
FIG. 5 is a flow diagram of a method of training and preventing a user's hand from slipping on a yoga mat, in accordance with aspects of the present disclosure.

Referring to FIG. 5, aspects of a method 500 of training and preventing a user's hand from slipping on a yoga mat is illustrated. The method 500 may include, for example, at 502, locating a portion of the yoga mat corresponding to where the user's hand is placed.

At 504, at least one device is adhered to the portion of the yoga mat. The device can be a rubberized device as described herein.

In related versions, the portion of the yoga mat corresponds to where the user's hand is placed in a specific yoga position. For example, the specific yoga position is downward dog, or any other yoga position.

In related versions, the method 500 can further comprise temporarily adhering the at least one device to the portion of the yoga mat to verify that it is an acceptable location.

In related versions, at least four devices are adhered to the portion of the yoga mat, each of the at least four devices corresponding to at least one metacarpophalangeal knuckle of the user's hand.

In related versions, the at least one device comprises a visual element. For example, the at least one device can comprise various colors, glow in the dark coloring, black light reactive coloring, patterns, glitter, visual cues, wording, or any other variety of decorative elements known in the art for alerting a user to the location of the at least one device on the yoga mat. Alternatively, the at least one device can be clear, opaque, and/or translucent, as known in the art. For example, part of the device can be opaque, part can be clear, and part can be translucent to create a unique decorative effect and visual cue. Additionally, visual teaching cues can be incorporated into the device as known in the art (e.g., within the body of the device, or otherwise) to act as yoga tips, reminders, encouragement, or otherwise for the user's reference during a yoga session.

In related versions, the method can further comprise placing the device at locations on the yoga mat that correspond to areas between the webbing of a user's hand. By doing so, hand slippage and proper form can be accomplished, according to the description herein.

The previous description of the disclosed aspects is provided to enable any person skilled in the art to make or use the present disclosure. Various modifications to these aspects will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The specification and drawings are, accordingly, to be regarded in an illustrative rather than a restrictive sense. It will, however, be evident that various modifications, combinations, and changes may be made thereunto without departing from the broader spirit and scope of the disclosure as set forth in the claims.

The description of the subject technology is provided to enable any person skilled in the art to practice the various embodiments described herein. While the subject technology has been particularly described with reference to the various figures and embodiments, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various embodiments described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted.

What is claimed is:

1. A device adapted to adhere to a yoga mat comprising:

a body comprising a convex portion and a planar portion; and an adhesive element on the planar portion for adhering the body to the yoga mat, wherein the adhesive element comprises a first adhesive layer and a second adhesive layer, the second adhesive layer is adjacent to the planar portion of the body, the first adhesive layer and the second adhesive layer are separated by a partition, the first adhesive layer is adapted to create a temporary bond between the body and the yoga mat, and the second adhesive layer is adapted to create a permanent bond between the body and the yoga mat wherein the body is configured to be placed on the yoga mat with the first adhesive layer to try a position, wherein the position can be made permanent by removing the body from the mat, removing the first adhesive layer to expose the second adhesive layer, and placing the body on the yoga mat with the second adhesive layer.

2. The device of claim 1 wherein the convex portion comprises a hemisphere.

3. A device adapted to adhere to a yoga mat comprising:

a rubberized body comprising a convex portion and a planar portion; and an adhesive element on the planar portion for adhering the body to the yoga mat, the adhesive element comprising a first temporary adhesive layer and a second permanent adhesive layer separated by a removable cover, wherein the body is configured to be temporarily placed on the yoga mat at a chosen location with the first adhesive layer, wherein the placement can be made permanent by removing the body from the mat, removing the first adhesive layer to expose the second adhesive layer, and placing the body on the yoga mat with the second adhesive layer.

4. The device of claim 3, wherein the convex portion comprises a hemisphere.

5. The device of claim 3 wherein the convex portion comprises a cube.

6. The device of claim 3 wherein the convex portion comprises a triangular prism.

7. The device of claim 3 wherein the rubberized body is sized to fit at least one metacarpophalangeal knuckle of a user.

8. The device of claim 3 wherein the rubberized body prevents a user's hand from slipping on the yoga mat.

9. A method of training and preventing a user's hand from slipping on a yoga mat comprising:

locating a portion of the yoga mat corresponding to where the user's hand is placed; and adhering at least one device of claim 1 to the portion of the yoga mat.

10. The method of claim 9 wherein the portion of the yoga mat corresponds to where the user's hand is placed in a specific yoga position.

11. The method of claim 10 wherein the specific yoga position is downward dog.

12. The method of claim 9 further comprising:

temporarily adhering the at least one device of claim 1 to the portion of the yoga mat to verify that it is an acceptable location.

13. The method of claim 9 wherein at least four devices of claim 1 are adhered to the portion of the yoga mat, each of the at least four rubberized devices corresponding to at least one metacarpophalangeal knuckle of the user's hand.

14. The method of claim 9 wherein the at least one device of claim 1 comprises a visual element.

* * * * *